United States Patent [19]

Rowley

[11] 3,940,055

[45] Feb. 24, 1976

[54] END LOAD CONTAINER

[75] Inventor: Cecil Alan Rowley, Kirkland, Canada

[73] Assignee: Domtar Limited, W. Montreal, Canada

[22] Filed: July 26, 1974

[21] Appl. No.: 492,036

[30] Foreign Application Priority Data

Aug. 24, 1971 Canada ..... 121263

[52] U.S. Cl. ..... 229/52 B; 206/163

[51] Int. Cl.[2] ..... B65D 5/46; B65D 25/28

[58] Field of Search ..... 206/163, 166, 172; 229/52 B

[56] References Cited

UNITED STATES PATENTS

| | | | |
|---|---|---|---|
| 3,498,496 | 3/1970 | Edwards | 229/52 B X |
| 3,807,625 | 4/1974 | Akkerman | 229/52 B |
| 3,820,710 | 6/1974 | Burgess et al. | 206/166 X |

*Primary Examiner*—Davis T. Moorhead

*Attorney, Agent, or Firm*—C. A. Rowley

[57] ABSTRACT

A blank and a carton are formed from a single piece of material and incorporate a sliding handle that is received within an envelope formed in the central partition of the carton and is movable from a retracted position within the carton to an extended position projecting above the top of the carton.

12 Claims, 13 Drawing Figures

FIG. 1

END LOAD CONTAINER

The present invention relates to an end-load container. More specifically, the present invention relates to an end-load container incorporating a sliding handle and formed from a single blank.

DESCRIPTION OF THE PRIOR ART

End-load containers incorporating sliding handles are known as exemplified by Canadian Pat. No. 737,787, issued July 5, 1966 to Hill et al, Canadian Pat. No. 872,656, issued June 8, 1971 to Cameron, and Canadian Pat. Nos. 737,786, 803,859 and 870,986 issued July 5, 1966, Jan. 14, 1969 and May 18, 1971 respectively to Atkinson. Of the above patents only Canadian Pat. No. 737,787 discloses a one-piece blank for forming a carton including a sliding handle. However, the carton having a sliding handle construction in accordance with the said Canadian Pat. No. 737,787 provides a carton that must have at least one glue joint formed on the packaging line.

SUMMARY OF THE INVENTION

It is the main object of the present invention to provide a knocked-down carton that may simply be erected on a packaging line without necessitating gluing or adhesively securing any of the joints except for the closing of the carton ends after filling.

Broadly the present invention comprises a blank and/or a carton adapted to provide a box with a longitudinally extending partition incorporating a sliding handle, said blank comprising a handle panel, a securing panel, an envelope panel and a partition panel foldably interconnected by a set of substantially parallel fold lines and handle panel connected to said securing panel by means of a line of weakness permitting said hand hole to be torn therefrom when it is lifted into an operative position in the carton.

The carton of the present invention broadly comprises a top, bottom side and end walls and a longitudinal partition formed by a partition panel having an envelope panel foldably connected to its top edge, a securing panel foldably connected to said envelope panel and positioned in face to face relationship with said partition panel and a handle forming panel releasably secured to the end of said securing panel remote from its connection with said handle panel, said handle forming panel being positioned between said partition panel. said handle forming panel being positioned between said envelope panel and said partition panel.

BRIEF DESCRIPTION OF THE DRAWING

Further features, objects and advantages will be evident from the following detailed description taken in conjunction with the accompanying drawings in which.

DESCRIPTION OF THE PREFERRED EMBODIMENTS

Figure 1:
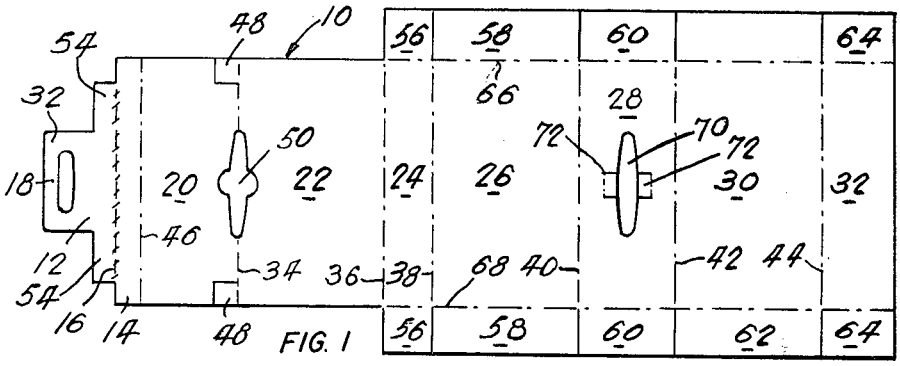
FIG. 1 is a plan view of a blank incorporating the present invention.

As shown in FIG. 1, the blank 10 comprises a handle forming panel 12 releasably secured to a securing panel 14 by means of a line of weakness 16. Envelope panel 20, partition panel 22, first bottom panel 24, first side panel 26, top panel 28, second side panel 30 and second bottom panel 32 are foldably interconnected by fold lines 34, 36, 38, 40, 42 and 44 respectively while the envelope panel 20 is foldably connected to the securing panel 14 by fold line 46. These fold lines 34, 36, 38, 40, 42, 44 and 46 and the line of weakness 16 are all substantially parallel.

The handle forming panel 12 has a handle section 52 with a hand hole 18 formed therein and a pair of abutment flanges 54, one on each side thereof.

A pair of tabs 48 are formed in the envelope panel 20 and are foldably connected to the partition panel 22 by means of fold line 34. If desired, these tabs 48 could have been formed in the panel 22 and remained foldably connected to the envelope panel 20 by means of fold line 34.

A handle opening 50 is provided on the junction between the envelope panel 20 and the partition panel 22 in a position to permit sliding of the handle section 52 of the handle panel 12 while the flanges 54 on opposite sides of the panel 12 are engaged by the fold line 34 to limit movement of the handle member as will be described in more detail hereinbelow.

End closure flaps 56, 58, 60, 62 and 64 are foldably connected one to each opposite end of the panels 24, 26, 28, 30 and 32 respectively by means of fold lines 66 and 68.

The top panel 28 is provided with a handle opening 70 and a pair of flaps 72 are foldable into the carton to permit fingers to grasp opposite sides of the handle panel 12 as will be described hereinbelow. The top panel 28 may also be provided with any suitable type of opening means, for example, lines of weakness around the periphery to permit the top panel to be torn off.

Formation of a carton from the blank of FIG. 1 is a relatively simple procedure only requiring folding over of the various panels about a set of parallel fold lines.

Figure 2:
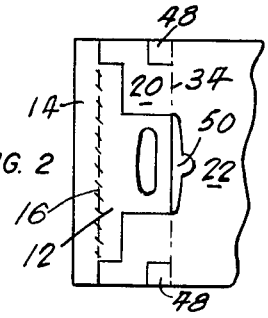
FIG. 2 illustrates the first step in folding of the blank.

The first step in forming the carton is to fold the panels 12 and 14 relative to the envelope panel 20 along fold line 46 so that the panels 12 and 14 overlie the panel 20 as shown in FIG. 2. If desired, the securing panel 14 may be secured to the envelope panel 20, for example by adhesive.

Figure 3:
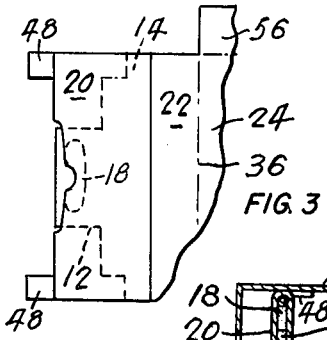
FIG. 3 illustrates the second step in folding of the blank.

The envelope panel 20 together with the panels 12 and 14 are then folded into overlying relationship with the partition panel 22 by folding along fold line 34 so that these panels 12, 14 and 20 now overlie the panel 22 and the panels 12 and 14 are in face-to-face relationship with the panel 22, with the panel 14 secured to the panel 22 if desired (see FIG. 3). In the illustrated embodiment the tabs 48 project outwardly from the panel 22 when the panels are folded as above described.

Figure 4:
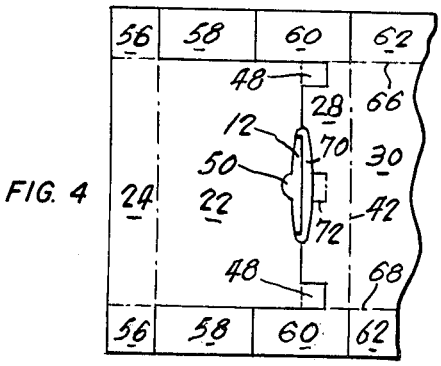
FIG. 4 shows the third step in folding of the blank.
Figure 5:
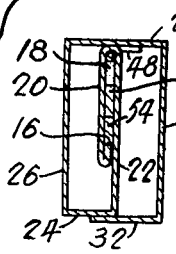
FIG. 5 is a section through a carton incorporating the present invention.

With the panels 20, 14 and 12 secured in position by the adhesive connection between the panel 14 and the panel 22, the blank is folded along fold line 38 so that the panels 24 and 22 overlie the panels 26 and 28 with the tabs 48 contacting the bottom surface of the top panel 28 adjacent the fold lines 66 and 68. These tabs 48 are secured to the top panel 26 thereby securing the partition panel with its envelope and handle panels in proper relationship with respect to the rest of the box (see FIG. 4).

The remainder of the manufacturing operation simply requires folding over of the panels 30 and 32 by folding along fold line 42 so that the panel 32 adjacent its free edge overlies the panel 24 and is adhesively secured thereto to form the manufacturer's joint.

Figure 6:
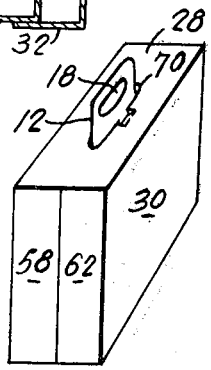
FIG. 6 is an isometric view of the carton showing the handle in operative position.

The above described carton need only be squared up on the packaging line, the bottles or cans or the like inserted, and the end flaps 56, 58, 60, 62 and 64 folded and secured in closed position to provide the finished carton. To facilitate carrying of the finished carton one need only bend the flaps 72 inward of the carton by means of the thumb and fore-finger and thereby reach in and engage the top edge of the handle forming panel 12 immediately above the hand hole opening 18 and pull the same upwardly to break its releasable connection 16 with the panel 14 and withdraw same to projected operative position above the top of the carton. The upward travel of the handle is limited by engagement of the flanges 54 with the fold line 34. The carton may then be carried by extending the hand through the hand hole 18 (see FIG. 6).

It will be apparent from the above that a relatively simple structure has been provided that is easily formed by the manufacturer and provides a convenient carrying handle.

Figure 7:
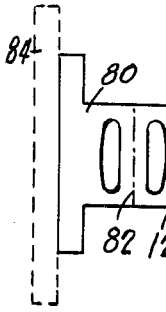
FIGS. 7 and 8 show modifications of the above blank illustrating ways of reinforcing the handle forming panel.
Figure 8:
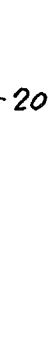

Further modifications are shown in FIGS. 7 and 8. In FIG. 7 a reinforcing panel 80, substantially identical to the handle panel 12, is foldably connected to the handle panel by fold line 82 which is substantially parallel to the fold lines 46, 34, 36, 38, 40, 42 and 44. Construction of the remainder of the box is substantially the same. To form the reinforced handle, the handle panel 80 is folded over onto the panel 12 and secured thereto before the panels 14 and 12 are folded over onto the panel 20 as above described. If desired, to provide adequate room for the double thickness handle, a spacer flap 84, shown in dotted lines, may be releasably secured to the handle 80 in the same manner as the handle 12 is secured to the panel 14. The flap 84 would overlie and could be secured to the panel 14. If desired, the flap 84 could simply be an extension of the reinforcing panel 80 and would not be secured to the panel 14 but would slide with the handle.

The arrangement of FIG. 8 provides a further mode of reinforcing the handle and incorporates a pair of partial handle panels 86 located one one each side of the central handle panel and secured thereto by fold lines 88 which are substantially perpendicular to the lines of connection 16 between the panels 12 and 14. These partial panels 86 are folded on the lines 88 into overlying relationship with the panel 12 to provide a double thickness handle section.

Figure 9:
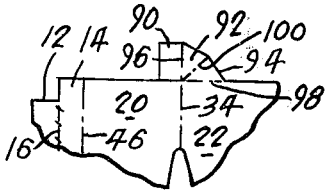
FIG. 9 shows yet a further modification of the present invention.

In some cases it may not be desirable to secure the partition panel 22 to the top panel 18 by means of the flaps 48 thereby to free the whole of the top panel 28 for removal. Under such circumstances the modification shown in FIG. 9, for example, may be used. As shown, the flaps 48 have been replaced by a pair of flaps 90 (only one shown) which project laterally from but are free from connection with the panel 20. This flap 90 is foldably connected to a pair of connecting panels 92 and 94 by fold line 96. The panel 94 is foldably connected to the panel 22 by fold line 98 while the panels 92 and 94 are foldably interconnected by a diagonal fold line 100. In assembling, the flaps 90 would be adhesively secured to the flaps 60.

Figure 10:
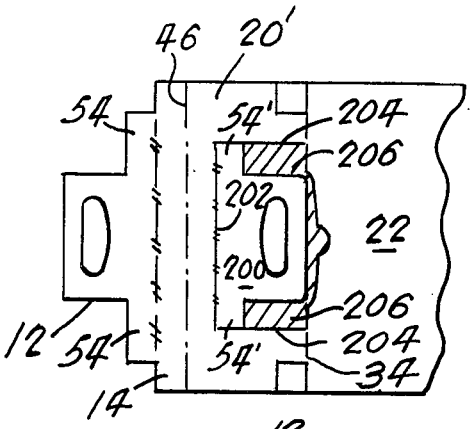
FIG. 10 is a partial plan view of a blank for forming a reinforcing handle with guide tracks for the handle.
Figure 11:
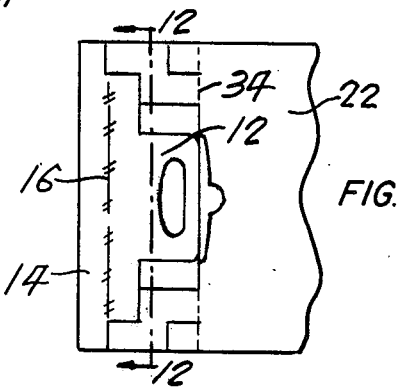
FIG. 11 is a partial plan view of one step in the manufacture of a box from the blank of FIG. 10.
Figure 12:
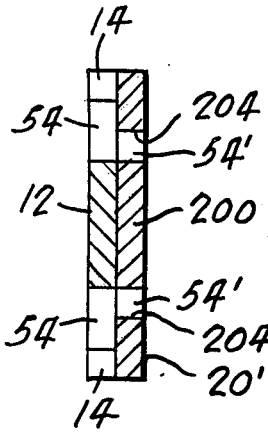
FIG. 12 is a section on the line 12—12 of FIG. 11.

The modification of FIGS. 10 to 12 provides a sliding handle that is guided for vertical movement from its retracted position inside the carton to its extended position by a pair of lateral guides.

As shown in FIG. 10, the blank has been modified in that the envelope panel 20′, equivalent to panel 20 of the previous embodiment, is formed with a handle member 200 releasably secured thereto by a frangible line of weakness 202. This handle member 200 has lateral flanges 54′ that are shorter than the lateral flanges 54. The ends of these flanges 54′ are defined by lines of severance 204 which project substantially parallel to the end edges of the panel 20′ beyond the flanges 54′ and terminate at the fold line 34. The areas cross-hatched and designated as 206 in the drawing are removed from the blank as are the hand hole openings.

It will be seen that the handle 200 is received within an aperture formed in the envelope panel 20′ by removal of the cross-hatched areas 206 and the end edges of the flanges 54′ are received between the lines of severance 204. These lines of severance cooperate with the end edges of the flanges 54′ to guide the sliding movement of the combined handle in a direction substantially parallel to these lines of severance 204.

Figure 13:
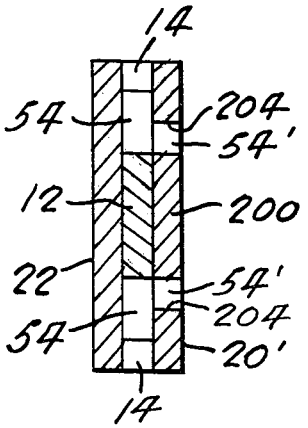
FIG. 13 is a section on the line 12—12 but after a further fold during the formation of the carton has been made.

In forming the carton from the blank of FIG. 10 the panels 14 and 12 are folded on fold line 46 so that the panel 12 completely overlaps the handle member 200 and is secured thereto by a suitable adhesive. As above indicated, the flanges 54 project beyond the ends of the flanges 54′ and thus these projecting ends of the flanges 54 are in face-to-face contact with the surface of the panel 20′. This will be clearly seen from FIGS. 11 and 12. When the next fold is made by folding on fold line 34 to position the panel 20′ into overlying relationship with the panel 22, the handle 12 is trapped between the panel 20′ and the panel 22. The ends of flanges 54′ and the lines of severance 204 cooperate to prevent endwise movement of the handle, i.e. the lines of severance 204 in effect forms guides for the ends of flanges 54′. This arrangement securely holds the reinforced handle in position and permits same to slide substantially vertically while preventing the handle from twisting or moving in directions perpendicular to the direction of movement from its retracted to its operative position (see FIG. 13).

A similar guiding arrangement can be obtained by providing a reinforcing handle similar to the handle 80 in the FIG. 7 embodiment but having end flanges shorter than the flanges 54 and by removing from the panel 20 an area equivalent to the combined area of the areas 206 and the handle 200 of the FIGS. 10–12 embodiment, so that the handle 80 after folding would fit into the aperture formed in the panel 20 in the same manner as the handle 200 and a similar guiding arrangement would be provided.

Also, the aperture formed by the areas 206 and thus the guide surfaces 204 could be formed in the partition panel 22, however, this would require folding of the "reinforcing" handle on the opposite side of the handle. Similarly, the handle 200 could be formed in the partition panel 22 and this panel 22 modified in the manner of the panel 20' of the FIGS. 10 to 12 embodiment.

Modifications may be made to the invention described herein without departing from the spirit of the invention as defined in the appended claims.

I claim:

1. A blank adapted to form an interior partition within a carton and an extensible handle member, said blank comprising a handle panel having a hand section and abutment flanges, a securing panel, a line of weakness connecting said handle panel to said securing panel to permit said handle panel to be torn therefrom, an envelope panel, a partition panel, said securing panel and said partition panel being connected to said envelope panel by substantially parallel fold lines positioned one on each end of said envelope panel and a handle opening along said fold line connection between said partition panel and said envelope panel, said opening permitting the handle section to be pulled through said opening into a carrying position wherein said flanges engage said fold line connection between said envelope and partition panels when said blank is formed into an interior partition.

2. A blank as defined in claim 1 further comprising a first bottom panel, a first side panel, a top panel, a second side panel and a second bottom panel foldably interconnected by a set of substantially parallel fold lines said first bottom panel being foldably connected by a fold line substantially parallel to said set of fold lines to the end of said partititon panel remote from said fold line connection between said envelope and said partition panels.

3. A blank as defined in claim 1 further comprising a handle reinforcing panel foldably connected to said handle Panel.

4. A blank as defined in claim 1 further comprising a handle reinforcing panel foldably connected to said handle panel by a fold line substantially parallel to said set of parallel fold lines and a spacer flap on said reinforcing handle panel.

5. A blank as defined in claim 4 wherein said flanges project laterally of said reinforcing handle panel, an aperture in said envelope panel, side edges of said aperture being spaced substantially the same distance as the spacing between end edges on said reinforcing panel, said side edges and said end edges being positioned to cooperate in the formed blank so that said edges function as guide surfaces.

6. A carton comprising means defined a top wall, bottom wall, side walls and end walls, and a longitudinally extending partition said partition including a partition panel, an envelope panel foldably connected to the end of said partition panel adjacent said top panel and positioned in spaced substantially parallel relationship with said partition panel, a securing panel foldably connected to the end of said envelope panel remote from its fold line connection to said partition panel, a handle panel having a handle section and abutment flanges, said handle panel connected to said securing panel via a line of weakness that may be broken when said handle is lifted to a carrying position, said securing panel and said handle panel being interposed between said envelope panel and said partition panel, means securing said securing panel to said partition panel, and a handle opening along said foldable connection between said partition panel and said envelope panel and means defining an access opening in said top walls through which said handle section may project when said handle is in a carrying position wherein said flanges engage said fold line connection between said envelope and said partition panels and means connecting said partition panel to said walls.

7. A carton as defined in claim 6 wherein said means connecting said partition panel to said walls comprises a fold line integrally connecting said partition panel to said bottom panel.

8. A carton as defined in claim 7 further comprising tab means foldably connected to said partition panel and secured to said top wall.

9. A carton as defined in claim 6 further comprising a handle reinforcing panel secured in face-to-face relationship with said handle forming panel to form a reinforced handle.

10. A carton as defined in claim 9 wherein said handle reinforcing panel is narrower than said handle panel, guide surfaces on said partition adapted to cooperate with end edges of said handle reinforcing panel to guide said handle panel for movement between a retracted and said carrying position.

11. A carton as defined in claim 10 wherein said guide surfaces are lateral edges of an aperture formed in said envelope panel.

12. A carton as defined in claim 10 wherein said guide surfaces are formed by lateral edges of an aperture formed in said partition panel.

* * * * *